US009224360B2

(12) United States Patent
Heo

(10) Patent No.: US 9,224,360 B2
(45) Date of Patent: Dec. 29, 2015

(54) DISPLAY DEVICE

(71) Applicant: Kyeong Yeol Heo, Yongin (KR)

(72) Inventor: Kyeong Yeol Heo, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 138 days.

(21) Appl. No.: 13/945,305

(22) Filed: Jul. 18, 2013

(65) Prior Publication Data

US 2014/0092073 A1 Apr. 3, 2014

(30) Foreign Application Priority Data

Sep. 28, 2012 (KR) ..... 10-2012-0109314

(51) Int. Cl.
*G09G 5/00* (2006.01)
*G09G 3/00* (2006.01)
*G09G 3/36* (2006.01)

(52) U.S. Cl.
CPC ..... *G09G 5/006* (2013.01); *G09G 3/006* (2013.01); *G09G 3/3648* (2013.01); *G09G 2310/0297* (2013.01); *G09G 2320/0693* (2013.01); *G09G 2330/08* (2013.01)

(58) Field of Classification Search
CPC ..... G09G 3/006; G09G 2320/029; G09G 2320/0295; G09G 2330/08; G09G 2330/10; G09G 2330/12
See application file for complete search history.

(56) References Cited

U.S. PATENT DOCUMENTS

2006/0022930 A1* 2/2006 Chen et al. ..... 345/98
2006/0156111 A1* 7/2006 Nozawa
2006/0192752 A1* 8/2006 Ando
2009/0273550 A1* 11/2009 Vieri et al. ..... 345/87

FOREIGN PATENT DOCUMENTS

KR 10-2007-0012018 A 1/2007
KR 10-2008-0049592 A 6/2008
KR 10-2012-0065754 A 6/2012

* cited by examiner

*Primary Examiner* — Regina Liang
(74) *Attorney, Agent, or Firm* — Lee & Morse, P.C.

(57) ABSTRACT

A display device includes a display panel, and a driving unit that generates driving signals for driving the display panel. The display panel receives the driving signals and outputs the driving signals as test driving signals. The driving unit includes an analog-digital converter to which the test driving signals are input, and includes a register that stores signal levels detected by the analog-digital converter.

18 Claims, 10 Drawing Sheets

DISPLAY DEVICE

CROSS-REFERENCE TO RELATED APPLICATION

This application claims priority under 35 U.S.C. §119 to Korean Patent Application No. 10-2012-0109314, filed on Sep. 28, 2012, in the Korean Intellectual Property Office, and entitled: "DISPLAY DEVICE," which is incorporated by reference herein in its entirety.

BACKGROUND

A display device may include a display panel that displays an image, a driving unit that drives the display panel, and a window that protects the display panel. The display device may also include housing member that houses the display panel, the driving unit, and the window therein.

SUMMARY

Embodiments may be realized by providing a display device that includes a display panel, a driving unit that generates driving signals for driving the display panel, wherein the display panel receives the driving signals and outputs the driving signals as test driving signals, and the driving unit includes an analog-digital converter to which the test driving signals are input, and includes a register that stores signal levels detected by the analog-digital converter.

The driving signals may include control signals for controlling the display panel, and the test driving signals may include test control signals generated from the control signals.

The display panel may include a plurality of gate lines arranged sequentially, the control signals may include a plurality of gate signals that are transmitted to the gate lines, respectively, and the test control signals may include test gate signals generated from ones of the plurality of gate signals. The ones of the plurality of gate signals may be transmitted to gate lines located farthest from a middle of the display panel from among the plurality of gate lines.

The display panel may include a plurality of data lines arranged sequentially, the control signals may include a plurality of data signals that are transmitted to the data lines, respectively, and the test control signals may include test data signals generated from ones of the plurality of data signals. The ones of the plurality of data signals may be transmitted to data lines located farthest from the middle of the display panel from among the plurality of data lines.

The display panel may include a plurality of pixels, and the control signals may be transmitted to ones of the pixels located adjacent to edges of the display panel. The driving signals may include a driving power supply voltage provided to the display panel, and the test driving signals may include a test driving power supply voltage generated from the driving power supply voltage.

The display device may further include a selector that receives the test driving signals and that transmits one of the test driving signals to the analog-digital converter. The driving signals may include control signals for controlling the display panel, and the test driving signals may include test control signals generated from the control signals.

The display panel may include a plurality of gate lines arranged sequentially, the control signals may include a plurality of gate signals that are transmitted to the gate lines, respectively, and the test control signals may include test gate signals generated from ones of the plurality of the gate signals. The test gate signals may be generated from gate signals that are transmitted to gate lines located farthest from the middle of the display panel from among the plurality of gate lines.

The display panel may include a plurality of data lines arranged sequentially, the control signals may include a plurality of data signals that are transmitted to the data lines, respectively, and the test control signals may include test data signals generated from at ones of the plurality of data signals. The test data signals may be generated from data signals that are transmitted to data lines located farthest from the middle of the display panel from among the plurality of data lines.

The driving signals may further include a driving power supply voltage provided to the display panel, and the test driving signals may further include a test driving power supply voltage generated from the driving power supply voltage.

Embodiments may also be realized by providing a display device that includes a display panel, and a driving unit that generates control signals for controlling the display panel, wherein the display panel receives the control signals and outputs the control signals as test control signals, and the driving unit includes an analog-digital converter to which the test control signals are input, and includes a register that stores signal levels detected by the analog-digital converter.

The display panel may include a plurality of gate lines arranged sequentially, the control signals may include a plurality of gate signals that are transmitted to the gate lines, respectively, and the test control signals may include test gate signals generated from ones of the plurality of gate signals. The ones of the plurality of gate signals may be transmitted to gate lines located farthest from a middle of the display panel from among the plurality of gate lines.

The display panel may include a plurality of data lines arranged sequentially, the control signals may include a plurality of data signals that are transmitted to the data lines, respectively, and the test control signals may include test data signals generated from ones of the plurality of data signals. The ones of the plurality of data signals may be transmitted to data lines located farthest from the middle of the display panel from among the plurality of data lines.

The display device may further include a selector that receives the test control signals and that transmits one of the test control signals to the analog-digital converter.

Embodiments may also be realized by providing a display device that includes a display panel, a driving unit that generates a driving power supply voltage for driving the display panel, wherein the display panel receives the driving power supply voltage and outputs the driving power supply voltage as a test driving power supply voltage, and the driving unit includes an analog-digital converter to which the test driving power supply voltage is input, and includes a register that stores a signal level detected by the analog-digital converter.

BRIEF DESCRIPTION OF THE DRAWINGS

Features will become more apparent to those of ordinary skill in the art by describing in detail exemplary embodiments thereof with reference to the attached drawings, in which.

DETAILED DESCRIPTION

Figure 1:
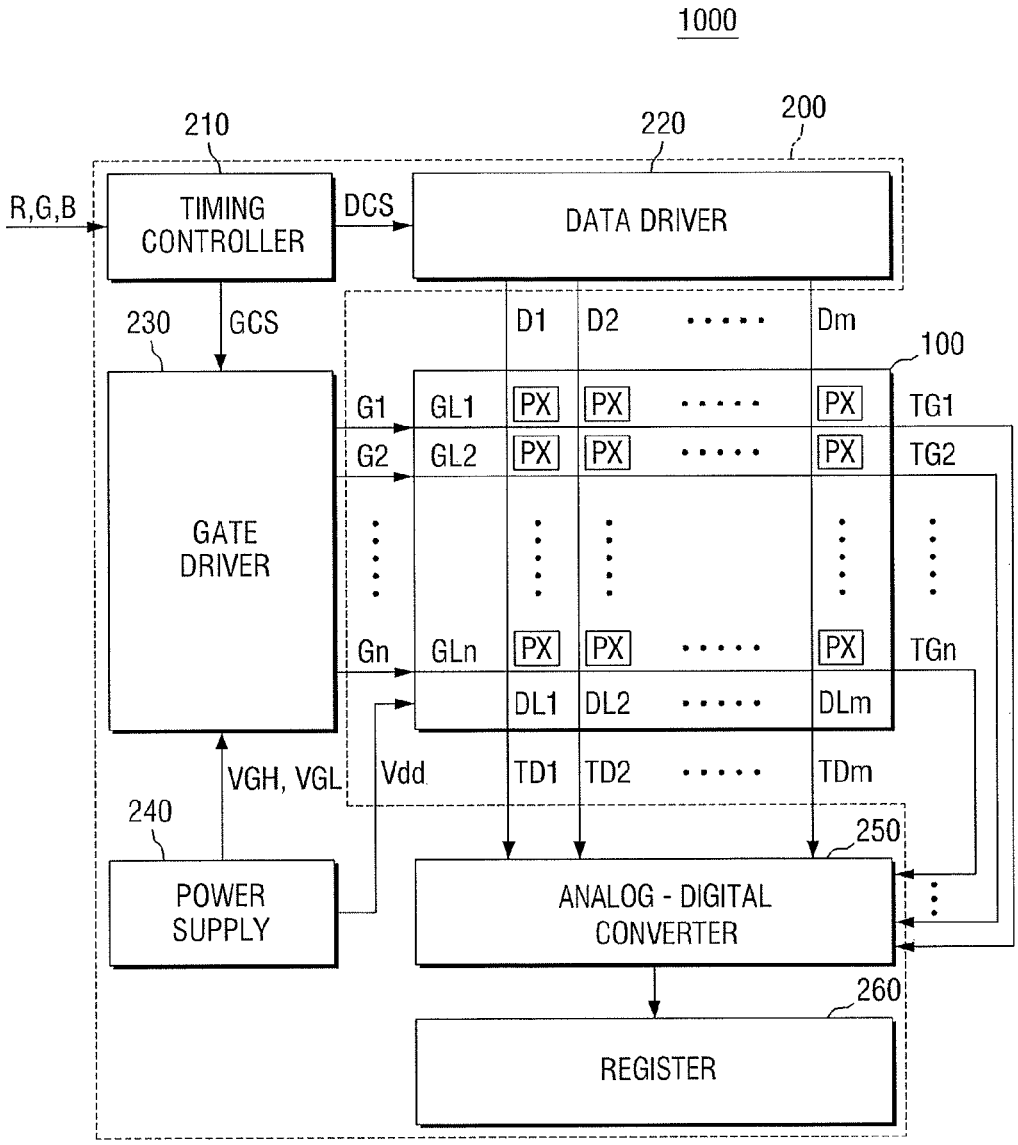
FIG. 1 is a block diagram of a display device according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey examples of implementations to those skilled in the art. Accordingly, known processes, elements, and techniques are not described with respect to some of the embodiments. Thus, in some embodiments, well-known structures and devices are not shown in order not to obscure the description with unnecessary detail. Like numbers refer to like elements throughout. In the drawings, the thickness of layers and regions are exaggerated for clarity.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings.

FIG. 1 is a block diagram of a display device 1000 according to an exemplary embodiment.

Referring to FIG. 1, the display device 1000 includes a display panel 100 and a driving unit 200.

The display panel 100 may display an image corresponding to driving signals provided by the driving unit 200. The driving signals may include a driving power supply voltage Vdd and control signals. The control signals may include first through $n^{th}$ gate signals G1 through Gn and first through $m^{th}$ data signals D1 through Dm. The control signals may include various types of signals in addition to the first through $n^{th}$ gate signals G1 through Gn and the first through $m^{th}$ data signals D1 through Dm. The types of the control signals may vary according to the type of the display panel 100. For example, if the display panel 100 is an organic electroluminescent display panel, the control signals may include an initialization signal and a light emission control signal in addition to the first through $n^{th}$ gate signals G1 through Gn and the first through $m^{th}$ data signals D1 through Dm. The control signals may include all signals that are provided to the display panel 100 so as to control an image displayed on the display panel 100. The control signals are not limited to the above-mentioned signals.

The display panel 100 may include first through $n^{th}$ gate lines GL1 through GLn, first through $m^{th}$ data lines DL1 through DLm, and a plurality of pixels PX. The first through $n^{th}$ gate signals G1 through Gn may be transmitted to the first through $n^{th}$ gate lines GL1 through GLn, respectively. The first through $m^{th}$ data lines DL1 through DLm may be arranged to intersect the first through $n^{th}$ gate lines GL1 through GLn. The first through $m^{th}$ data signals D1 through Dm may be transmitted to the first through $m^{th}$ data lines DL1 through DLm, respectively. The pixels PX may be defined by regions in which the first through $n^{th}$ gate lines GL1 through GLn intersect the first through $m^{th}$ data lines DL1 through DLm, respectively. The pixels PX may emit light in response to the control signals provided by the driving unit 200. For example, the pixels PX may determine whether to receive the first through $m^{th}$ data signals D1 through Dm corresponding to the first through $n^{th}$ gate signals G1 through Gn and may emit light at gray levels corresponding to the received first through $m^{th}$ data signals D1 through Dm. The pixels PX will now be described in more detail with reference to FIG. 2.

Figure 2:
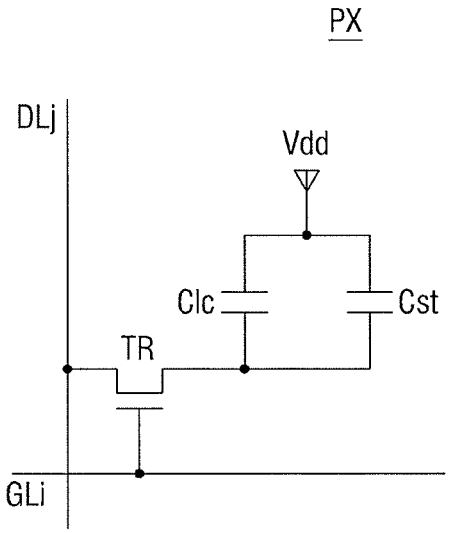
FIG. 2 is a circuit diagram of a pixel according to an exemplary embodiment.

FIG. 2 is a circuit diagram of a pixel PX according to an exemplary embodiment. For example, FIG. 2 is a circuit diagram of a pixel PX in a case where the display panel 100 is a liquid crystal display (LCD) panel. The circuit diagram of the pixel PX may be varied according to the type of the display panel 100. Referring to FIG. 2, the pixel PX may include a transistor TR, a liquid crystal capacitor Clc, and a storage capacitor Cst.

A gate of the transistor TR may be connected to an $i^{th}$ gate line GLi, a source of the transistor TR may be connected to a $j^{th}$ data line DLj, and a drain of the transistor TR may be connected to a terminal of the liquid crystal capacitor Clc and a terminal of the storage capacitor Cst (where "i" is a natural number ranging from 1 to n, and "j" is a natural number ranging from 1 to m). The transistor TR is turned on when a voltage level of an gate signal Gi transmitted to the $i^{th}$ gate line GLi is equal to or higher than a threshold voltage. The turned-on transistor TR allows a $j^{th}$ data signal Dj transmitted to the $j^{th}$ data line DLj to be delivered to the liquid crystal capacitor Clc and the storage capacitor Cst.

A terminal of the liquid crystal capacitor Clc may be connected to the drain of the transistor TR, and the driving power supply voltage Vdd may be applied to the other terminal of the liquid crystal capacitor Clc. The liquid crystal capacitor Clc may indicate the capacitance of a liquid crystal layer (not shown) included in the display panel 100. The liquid crystal layer may include a plurality of liquid crystal particles. The arrangement of the liquid crystal particles may change according to a voltage applied to the liquid crystal capacitor Clc, thereby changing light transmittance of the display panel 100.

A terminal of the storage capacitor Cst may be connected to the drain of the transistor TR, and the driving power supply voltage Vdd may be applied to the other terminal of the storage capacitor Cst. The storage capacitor Cst may be connected, in parallel, to the liquid crystal capacitor Clc, thereby increasing total capacitance in the pixel PX. The increased total capacitance increases a period of time during which a voltage applied to the liquid crystal capacitor Clc is maintained when the transistor TR is turned off. According to some embodiments, the storage capacitor Cst may be omitted.

Referring back to FIG. 1, the display panel 100 may output a plurality of test control signals. The test control signals may be the control signals that are input to the display panel 100 and then are output after passing through the display panel 100. The test control signals may be the control signals that are output as they are from the display panel 100 or may be the control signals that are output through a predetermined circuit.

The test control signals may include, e.g., first through $n^{th}$ test gate signals TG1 through TGn generated from the first through $n^{th}$ gate signals G1 through Gn, respectively, and first through $m^{th}$ test data signals TD1 through TDm generated from the first through $m^{th}$ data signals D1 through Dm, respectively. If the control signals include other signals in addition to the first through $n^{th}$ gate signals G1 through Gn and the first through $m^{th}$ data signals D1 through Dm, the test control signals may include output signals of the display panel 100 which correspond to the above signals.

In FIG. 1, the display panel 100 outputs the first through nth test gate signals TG1 through TGn and the first through $m^{th}$ test data signals TD1 through TDm as the test control signals. However, according to some embodiments, the display panel 100 may output the first through $n^{th}$ test gate signals TG1 through TGn or the first through $m^{th}$ test data signals TD1 through TDm as the test control signals. According to some other embodiments, the display panel 100 may output only some of the first through $n^{th}$ test gate signals TG1 through TGn and the first through $m^{th}$ test data signals TD1 through TDm as the test control signals.

The driving unit 200 may receive image data R, G, B, generate driving signals for driving the display panel 100 to display an image corresponding to the image data R, G, B, and provide the generated driving signals to the display panel 100. The driving signals may include the driving power supply voltage Vdd and the control signals. The driving unit 200 may receive the test control signals, e.g., each of the first through $m^{th}$ test data signals TD1 through TDm and each of the first through $m^{th}$ test data signals TD1 through TDm, and may detect voltage levels of the test control signals. Then, the driving unit 200 may determine whether the detected voltage levels of the test control signals are normal. Thus, whether wirings of the display device 1000 are defective may be determined without disassembling the display device 1000. The driving unit 200 may be, but is not limited to, a single integrated circuit (IC) chip.

The driving unit 200 may include an analog-digital converter 250 and a register 260. The analog-digital converter 250 may receive the test control signals, e.g., all of the first through $m^{th}$ test data signals TD1 through TDm and all of the first through $m^{th}$ test data signals TD1 through TDm, and may detect the voltage levels of the test control signals. The analog-digital converter 250 may further convert the detected voltage levels of the test control signals into digital values, and store the digital values in the register 260. The register 260 may store values corresponding to the voltage levels of the test control signals. The values stored in the register 260 may be read from outside the display device 1000 to detect the voltage levels of the test control signals.

According to an exemplary embodiment, since the display device 1000 includes the analog-digital converter 250 and the register 260, the voltage levels of the test control signals may be read through the analog-digital converter 250 and the register 260 from outside the display device 1000 without disassembling the display device 1000. Accordingly, whether the wirings of the display device 1000 are defective may be determined based on whether the voltage levels of the test control signals are normal. Since whether the wirings of the display device 1000 are defective may be determined without disassembling the display device 1000, the process of determining whether the wirings are defective is simple, and defects that occur in the process of disassembling the display device 1000 may be prevented.

The driving unit 200 may further include a timing controller 210, a data driver 220, a gate driver 230, and a power supply 240. The timing controller 210 may receive the image data R, G, B. The timing controller 210 may generate a gate driver control signal GCS for controlling the gate driver 230 according to the image data R, G, B, and may generate a data driver control signal DCS for controlling the data driver 220 according to the image data R, G, B.

The gate driver 230 may receive the gate driver control signal GCS and generate the first through $n^{th}$ gate signals G1 through Gn corresponding to the gate driver control signal GCS. The gate driver 230 may receive a gate high voltage VGH and a gate low voltage VGL from the power supply 240, and the first through $n^{th}$ gate signals G1 through Gn may have a voltage level of the gate high voltage VGH or a voltage level of the gate low voltage VGL. To easily determine whether the wirings are defective, the gate driver 230 may output the first through $n^{th}$ gate signals G1 through Gn continuously having the voltage level of the gate high voltage VGH or the first through $n^{th}$ gate signals G1 through Gn continuously having the voltage level of the gate low voltage VGL.

The data driver 200 may receive the data driver control signal DCS and generate the first through $m^{th}$ data signals D1 through Dm corresponding to the data driver control signal DCS. To easily determine whether the wirings are defective, the data driver 200 may generate the first through $m^{th}$ data signals D1 through Dm that continuously output a voltage level corresponding to a certain gray level. According to some embodiments, to easily determine whether the wirings are defective, the data driver 200 may generate the first through $m^{th}$ data signals D1 through Dm that continuously output a voltage level corresponding to a maximum gray level.

The power supply 240 may generate the driving power supply voltage Vdd and provide the driving power supply voltage Vdd to the display panel 100. In addition, the power supply 240 may generate the gate high voltage VGH and the gate low voltage VGL and provide the gate high voltage VGH and the gate low voltage VGL to the gate driver 230.

Figure 3:
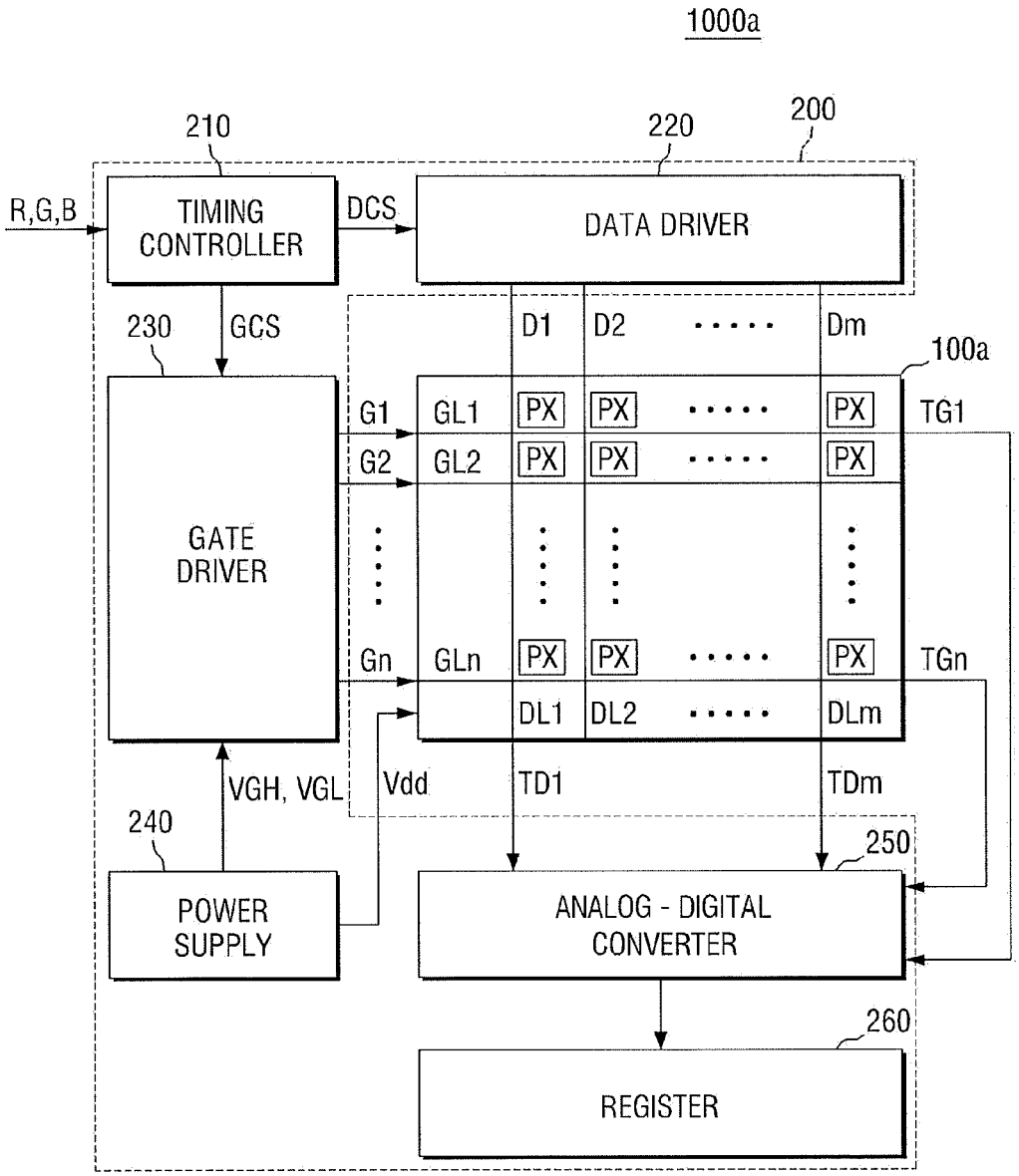
FIG. 3 is a block diagram of a display device according to an exemplary embodiment.

Another exemplary embodiment will now be described with reference to FIG. 3. FIG. 3 is a block diagram of a display device 1000*a* according to the exemplary embodiment.

Referring to FIG. 3, the display device 1000*a* includes a display panel 100*a* and a driving unit 200.

The display panel 100*a* may output control signals, which are transmitted to pixels PX located adjacent to edges of the display panel 100*a* from among a plurality of pixels PX, as test control signals. For example, the test control signals may include a first test gate signal TG1 and an $n^{th}$ test gate signal TGn corresponding to a first gate signal G1 and an $n^{th}$ gate signal GLn, which are transmitted to a first gate line GL1 and an $n^{th}$ gate line GLn, respectively, that are located farthest from the middle of the display panel 100*a* from among first through $n^{th}$ gate lines GL1 through GLn. According to some embodiments, the test control signals may include any one of the first test gate signal TG1 and the $n^{th}$ test gate signal TGn.

The test control signals may include a first test data signal TD1 and an $m^{th}$ test data signal TDm corresponding to a first data signal D1 and an $m^{th}$ data signal Dm, which are transmitted to a first data line DL1 and an $m^{th}$ data line DLm, respectively, that are located farthest from the middle of the display panel 100*a* from among first through $m^{th}$ data lines DL1 through DLm. According to some embodiments, the test control signals may include any one of the first test data signal TD1 and the $m^{th}$ test data signal TDm.

The display panel 100*a* may also receive other control signals in addition to the first through $n^{th}$ gate signals G1 through Gn, and the first through $m^{th}$ data signals D1 through Dm. In this case, in the same way with the first through $n^{th}$ gate signals G1 through Gn and the first through $m^{th}$ data signals D1 through Dm, the display panel 100*a* may output control signals, which are transmitted to pixels PX located adjacent to the edges of the display panel 100*a*, as the test control signals.

The pixels PX located adjacent to the edges of the display panel 100*a* are more likely to have wiring defects, e.g., due to peeling of the display panel 100*a* or an external impact, than pixels PX located close to the middle of the display panel 100*a*. Therefore, even if the control signals transmitted only to the pixels PX located adjacent to the edges of the display panel 100*a* are output as the test control signals, the probability that the wiring defects of the display device 1000*a* will be detected may be maintained high.

If the control signals transmitted only to the pixels PX located adjacent to the edges of the display panel 100*a* are output as the test control signals, the number of test control signals input to an analog-digital converter 250 is reduced. Accordingly, the number of input terminals of the analog-digital converter 250 may be reduced. When the driving unit 200 is formed as a single IC chip, if the control signals transmitted only to the pixels PX located adjacent to the edges of the display panel 100*a* are output as the test control signals, the number of input terminals of the driving unit 200 may be reduced.

For simplicity, other elements substantially identical to those of FIG. 1 are indicated by like reference numerals, and thus their description is omitted.

Figure 4:
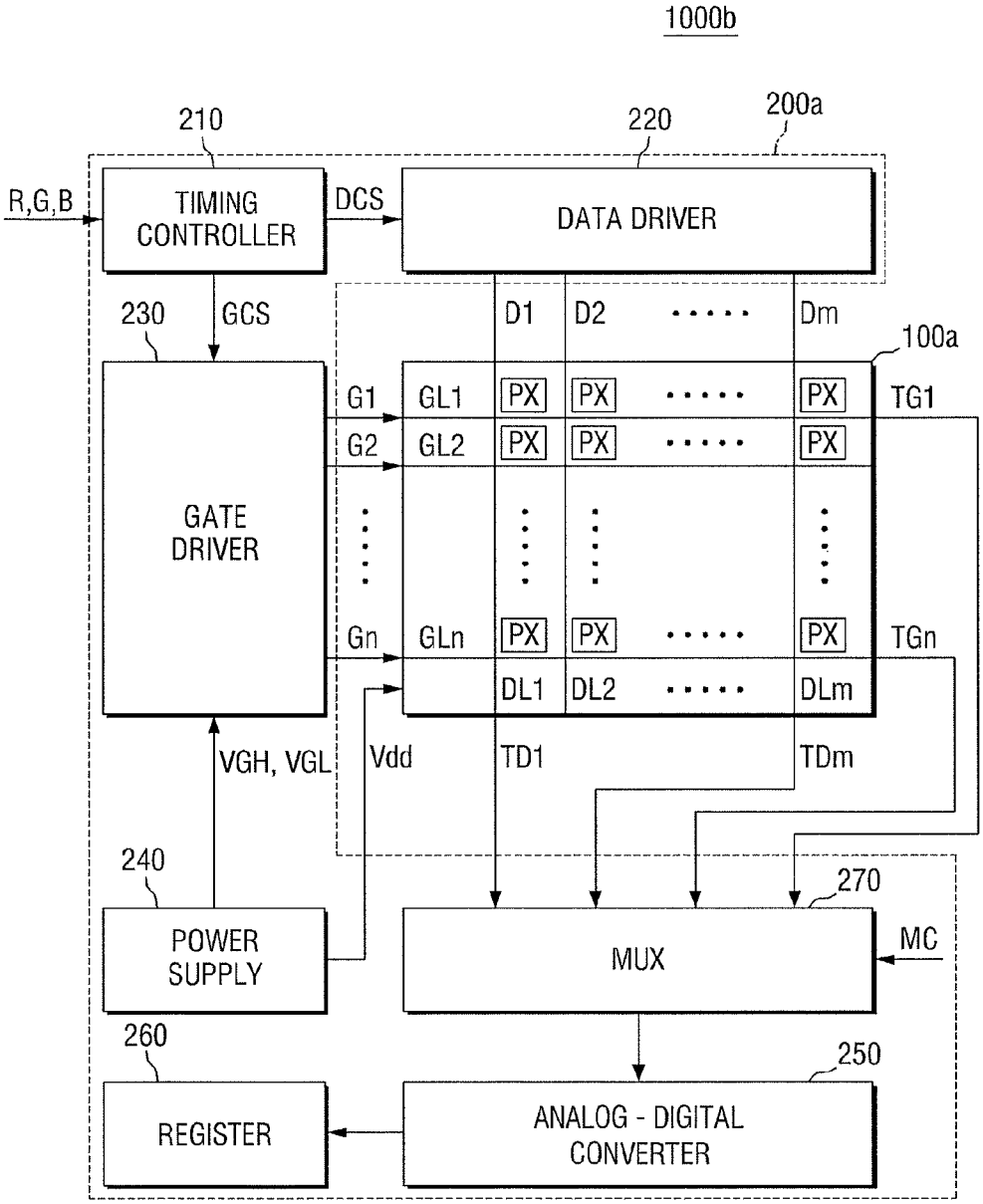
FIG. 4 is a block diagram of a display device according to an exemplary embodiment.

Another exemplary embodiment will now be described with reference to FIG. 4. FIG. 4 is a block diagram of a display device 1000*b* according to the exemplary embodiment.

Referring to FIG. 4, the display device 1000*b* includes a display panel 100*a* and a driving unit 200*a*. The driving unit 200*a* may include a timing controller 210, a data driver 220, a gate driver 230, a power supply 240, an analog-digital converter 250, a register 260, and a selector (MUX) 270.

The selector 270 may receive a plurality of test control signals, select one of the test control signals, and transmit the selected test control signal to the analog-digital converter 250. Referring to FIG. 4 the selector 270 may receive, e.g., a first test data signal TD1, an $m^{th}$ test data signal TDm, a first test gate signal TG1, and an $n^{th}$ test gate signal TGn as test control signals, select one of the test control signals, and provide the selected test control signal to the analog-digital converter 250. Since the display device 1000*b* includes the selector 270, which receives a plurality of test control signals, selects one of the received test control signals, and transmits the selected test control signal to the analog-digital converter 250, the number of input terminals of the analog-digital converter 250 may be reduced.

The selector 270 may receive a selection control signal MC and select a test control signal corresponding to the selection control signal MC from a plurality of test control signals. The selection control signal MC may be generated by the timing controller 210, may be generated by a microprocessor (not shown) outside the driving unit 200, or may be input from outside the display device 1000*b*. The selector 270 may be formed as a multiplexer.

For simplicity, other elements substantially identical to those of FIG. 3 are indicated by like reference numerals, and thus their description is omitted.

Figure 5:
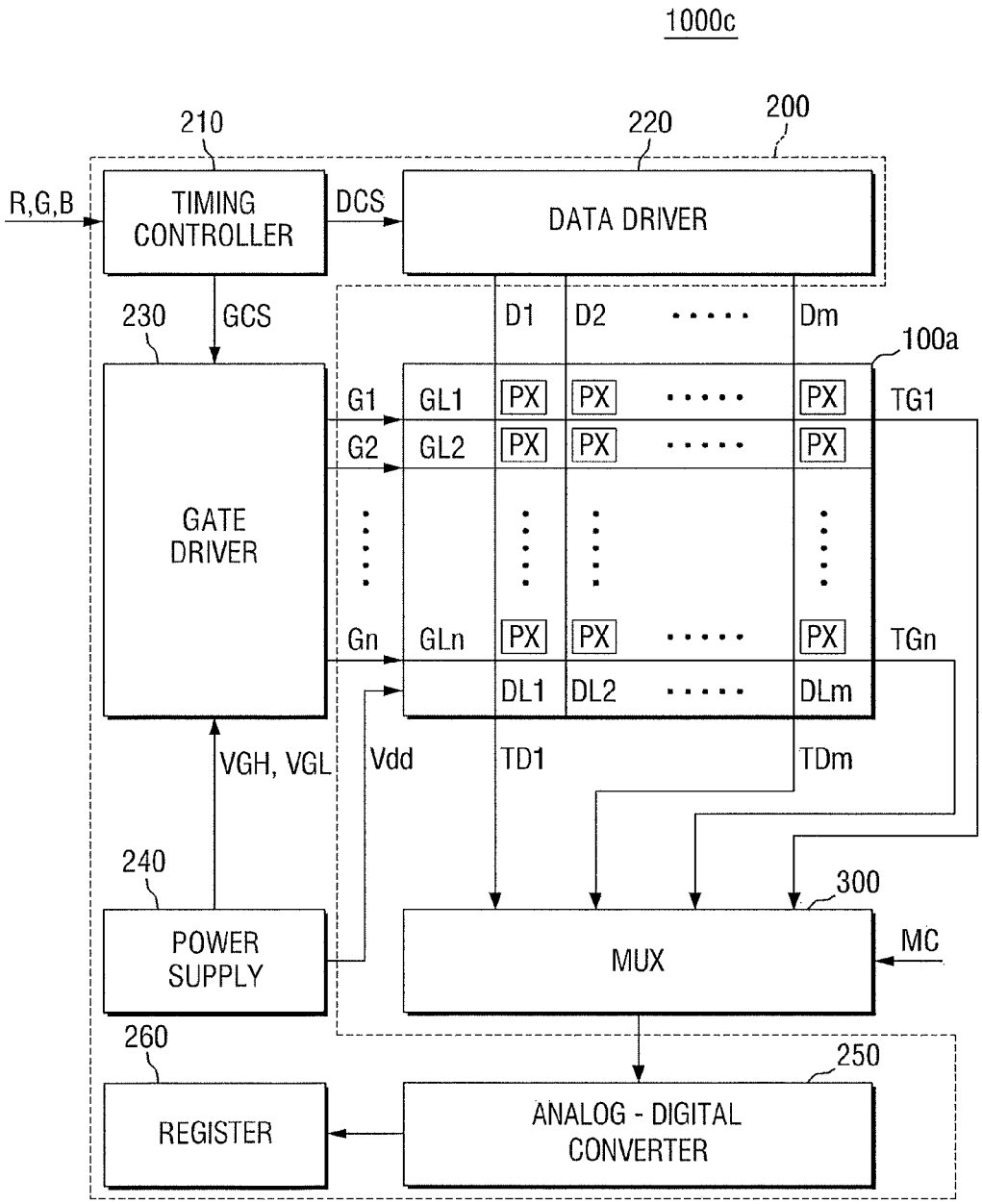
FIG. 5 is a block diagram of a display device according to an exemplary embodiment.

Another exemplary embodiment will now be described with reference to FIG. 5. FIG. 5 is a block diagram of a display device 1000*c* according to the exemplary embodiment.

Referring to FIG. 5, the display device 1000*c* may include a display panel 100*a*, a driving unit 200, and a selector 300. The selector 300 may be a separate element not included in the driving unit 200. When the selector 300 is formed as a separate element not included in the driving unit 200, if the driving unit 200 is formed as a single IC chip, the number of input terminals of the driving unit 200 may be reduced. For simplicity, other elements substantially identical to those of FIG. 3 are indicated by like reference numerals, and thus their description is omitted.

Figure 6:
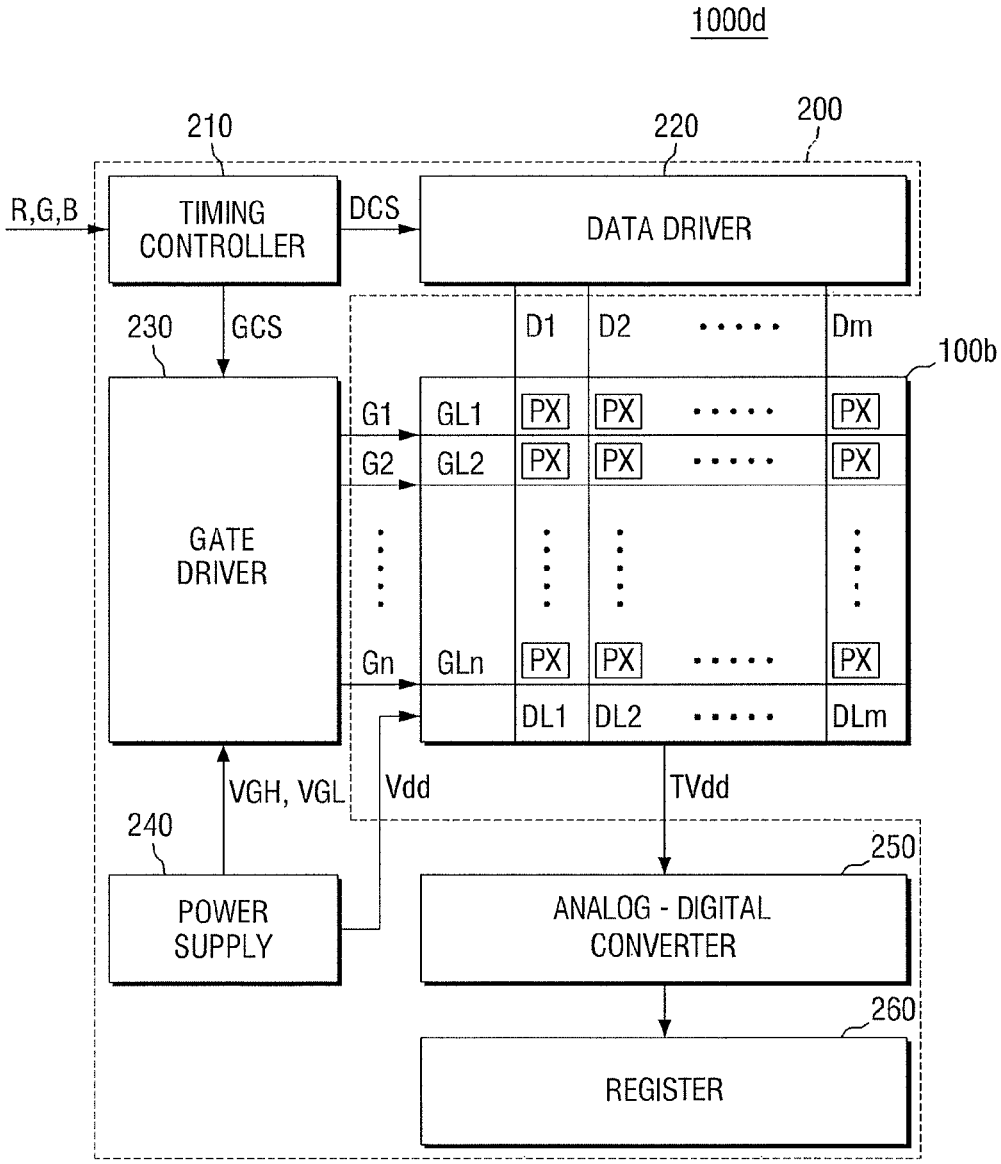
FIG. 6 is a block diagram of a display device according to an exemplary embodiment.

Another exemplary embodiment will now be described with reference to FIG. 6. FIG. 6 is a block diagram of a display device 1000*d* according to the exemplary embodiment.

Referring to FIG. 6, the display device 1000*d* includes a display panel 100*b* and a driving unit 200. The display panel 100*b* may output a test driving power supply voltage TVdd and provide the test driving power supply voltage TVdd to the driving unit 200, e.g., to the analog-digital converter 250. The test driving power supply voltage TVdd may be a driving power supply voltage Vdd input to the display panel 100*b* and then output after passing through the display panel 100*b*.

The driving unit 200 may receive the test driving power supply voltage TVdd, detect a voltage level of the test driving power supply voltage TVdd, and determine whether a wiring to which the driving power supply voltage Vdd is applied is defective. For example, the analog-digital converter 250 included in the driving unit 200 may receive the test driving power supply voltage TVdd, convert the voltage level of the test driving power supply voltage TVdd into a digital value, and store the digital value in a register 260. The digital value stored in the register 260 may be read to determine whether the voltage level of the test driving power supply voltage TVdd is normal. Whether the wiring to which the driving power supply voltage Vdd is applied is defective may be determined based on whether the voltage level of the test driving power supply voltage TVdd is normal.

For simplicity, other elements substantially identical to those of FIG. 1 are indicated by like reference numerals, and thus their description is omitted.

Figure 7:
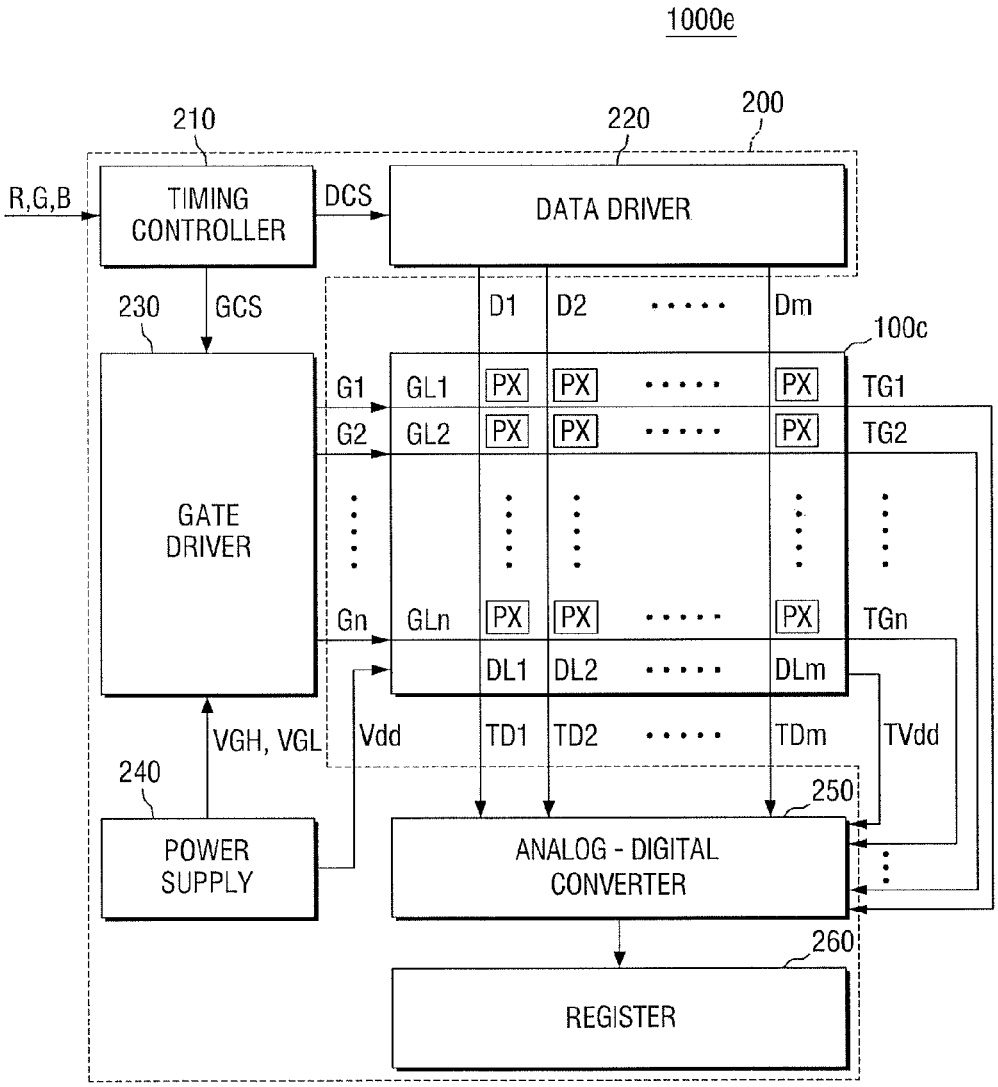
FIG. 7 is a block diagram of a display device according to an exemplary embodiment.

Another exemplary embodiment will now be described with reference to FIG. 7. FIG. 7 is a block diagram of a display device 1000*e* according to the exemplary embodiment.

Referring to FIG. 7, the display device 1000*e* includes a display panel 100*c* and a driving unit 200.

The display panel 100*c* may receive driving signals and output test driving signals. The driving signals may include a driving power supply voltage Vdd and control signals. The test driving signals may include a test driving power supply voltage TVdd and test control signals. The test control signals may include first through $n^{th}$ test gate signals TG1 through TGn and first through $m^{th}$ test data signals TD1 through TDm. In addition, the test control signals may include signals generated from the control signals for the controlling the operation of the display panel 100*c*.

The driving unit 200 may receive the test driving signals, detect voltage levels of the test driving signals, and determine whether wirings to which the driving power supply voltage Vdd and the control signals are transmitted are defective. For example, an analog-digital converter 250 included in the driving unit 200 may receive the test driving power supply voltage TVdd and the test control signals, convert voltage levels of the test driving power supply voltage TVdd and the test control signals into digital values, and store the digital values in a register 260. The digital values stored in the register 260 may be read to determine whether the voltage levels of the test driving power supply voltage TVdd and the test control signals are normal. Whether the wirings to which the driving power supply voltage Vdd and the control signals are transmitted are defective may be determined based on whether the voltage levels of the test driving power supply voltage TVdd and the test control signals are normal.

For simplicity, other elements substantially identical to those of FIG. 1 are indicated by like reference numerals, and thus their description is omitted.

Figure 8:
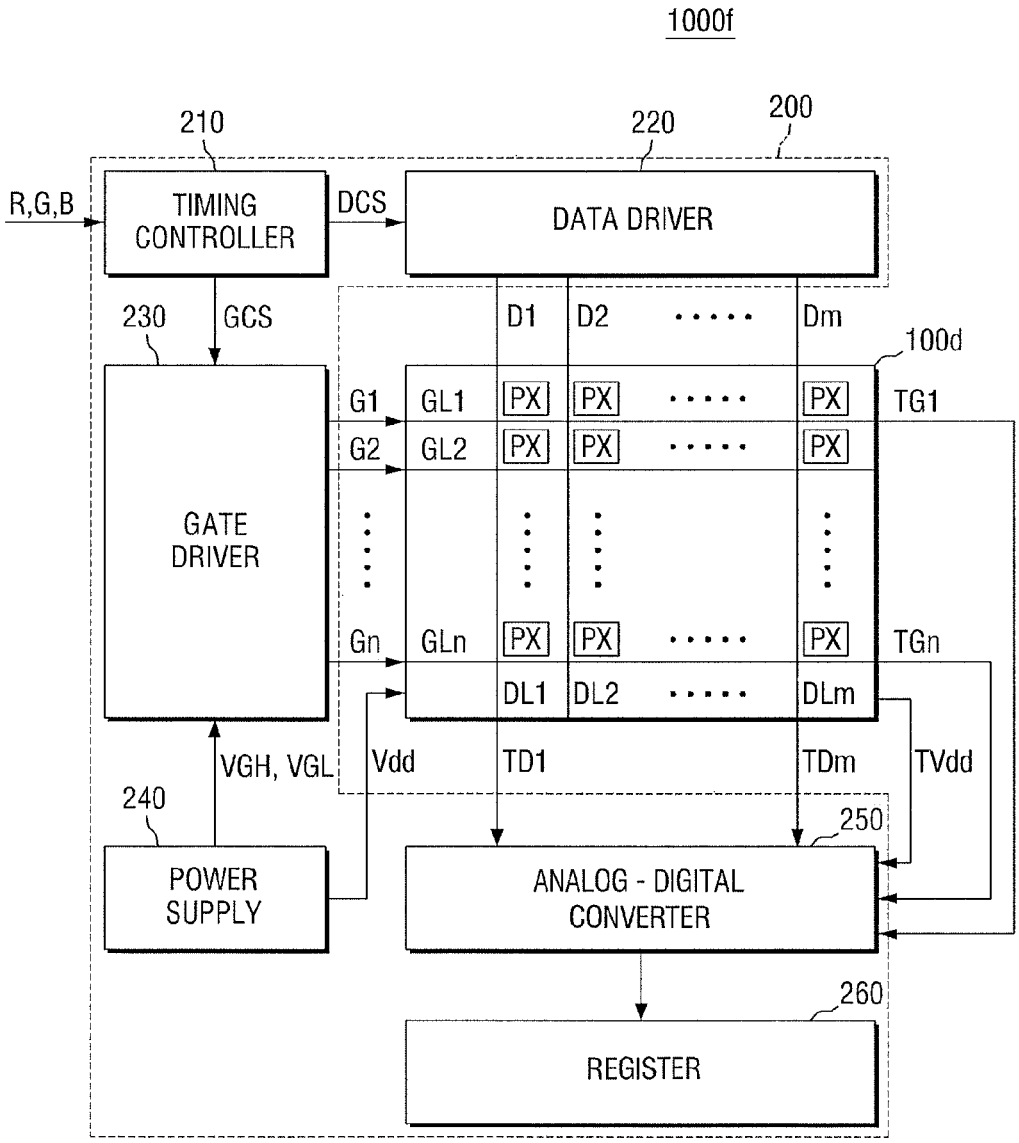
FIG. 8 is a block diagram of a display device according to an exemplary embodiment.

Another exemplary embodiment will now be described with reference to FIG. 8. FIG. 8 is a block diagram of a display device 1000*f* according to the exemplary embodiment.

Referring to FIG. 8, the display device 1000*f* includes a display panel 100*d* and a driving unit 200.

The display panel 100*d* may receive driving signals and output test driving signals. The driving signals may include a driving power supply voltage Vdd and control signals. The test driving signals may include a test driving power supply voltage TVdd and test control signals. The test control signals may be signals generated from control signals which are transmitted to pixels PX located adjacent to edges of the display panel 100*d* from among a plurality of pixels PX. The test control signals may not be generated from control signals, which are transmitted to pixels PX located close to the middle of the display panel 100*d*. The pixels PX located adjacent to the edges of the display panel 100*d* are more likely to have wiring defects due to peeling of the display panel 100*d* or external impact than the pixels PX located close to the middle of the display panel 100*d*. Therefore, the wiring defect detection probability may be maintained high while the number of terminals of the driving unit 200 for receiving the test driving signals is reduced.

For simplicity, other elements substantially identical to those of FIG. 3 are indicated by like reference numerals, and thus their description is omitted.

Figure 9:
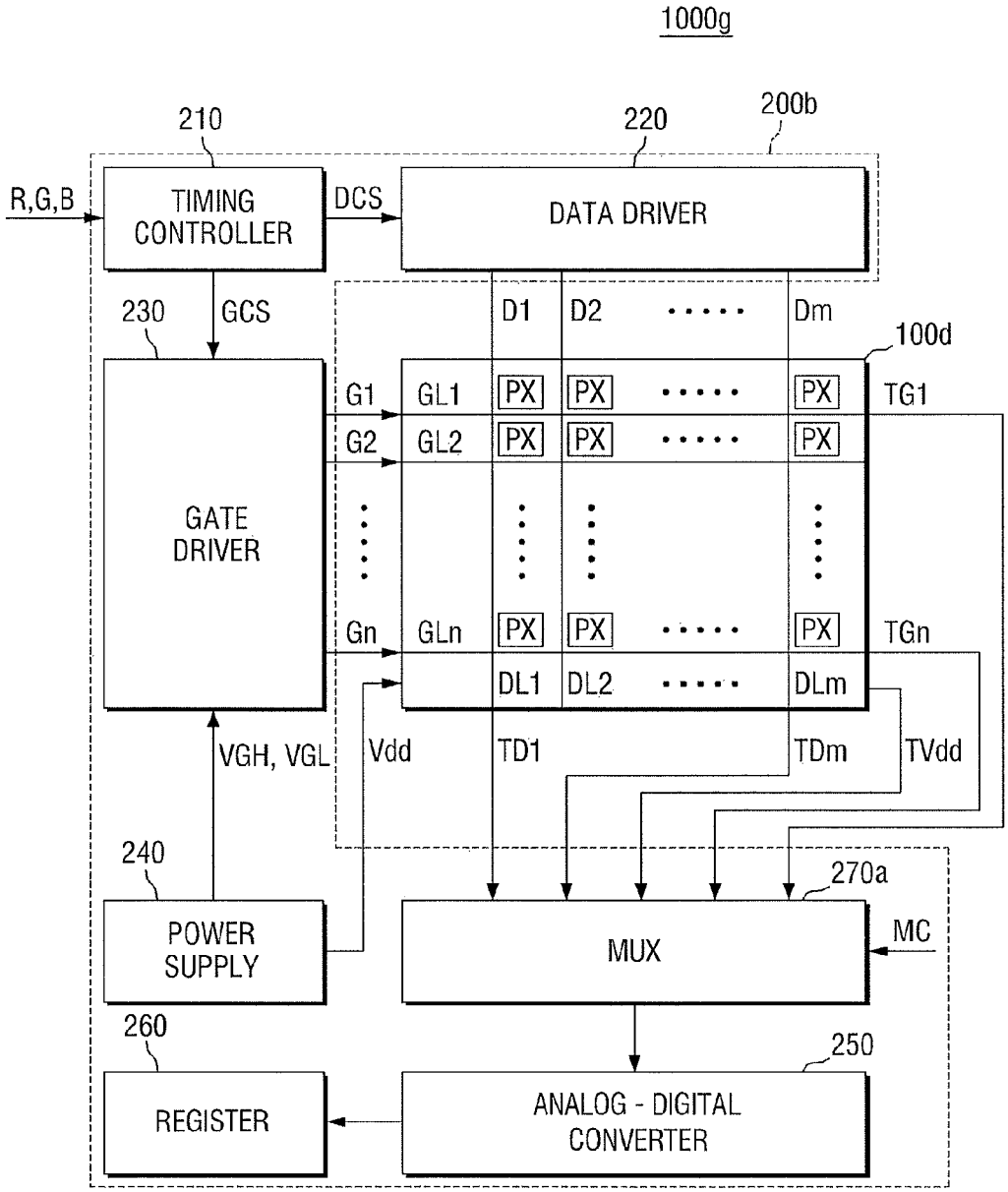
FIG. 9 is a block diagram of a display device according to an exemplary embodiment.

Another exemplary embodiment will now be described with reference to FIG. 9. FIG. 9 is a block diagram of a display device 1000*g* according to the exemplary embodiment.

Referring to FIG. 9, the display device 1000*g* includes a display panel 100*d* and a driving unit 200*b*. The driving unit 200*b* may include a timing controller 210, a data driver 220, a gate driver 230, a power supply 240, an analog-digital converter 250, a register 260, and a selector 270*a*.

The selector 270*a* may receive a plurality of test driving signals, select one of the test driving signals, and transmit the selected test driving signal to the analog-digital converter 250. In FIG. 9, the selector 270*a* may receive a first test data signal TD1, an mth test data signal TDm, a first test gate signal TG1, an nth test gate signal TGn, and a test driving power supply voltage TVdd as test driving signals, select one of the test driving signals, and provide the selected test driving signal to the analog-digital converter 250. Since the display device 1000*g* includes the selector 270*a*, which receives a plurality of test driving signals, selects one of the received test driving signals, and transmits the selected test driving signal to the analog-digital converter 250, the number of input terminals of the analog-digital converter 250 may be reduced.

For simplicity, other elements substantially identical to those of FIG. 3 are indicated by like reference numerals, and thus their description is omitted.

Figure 10:
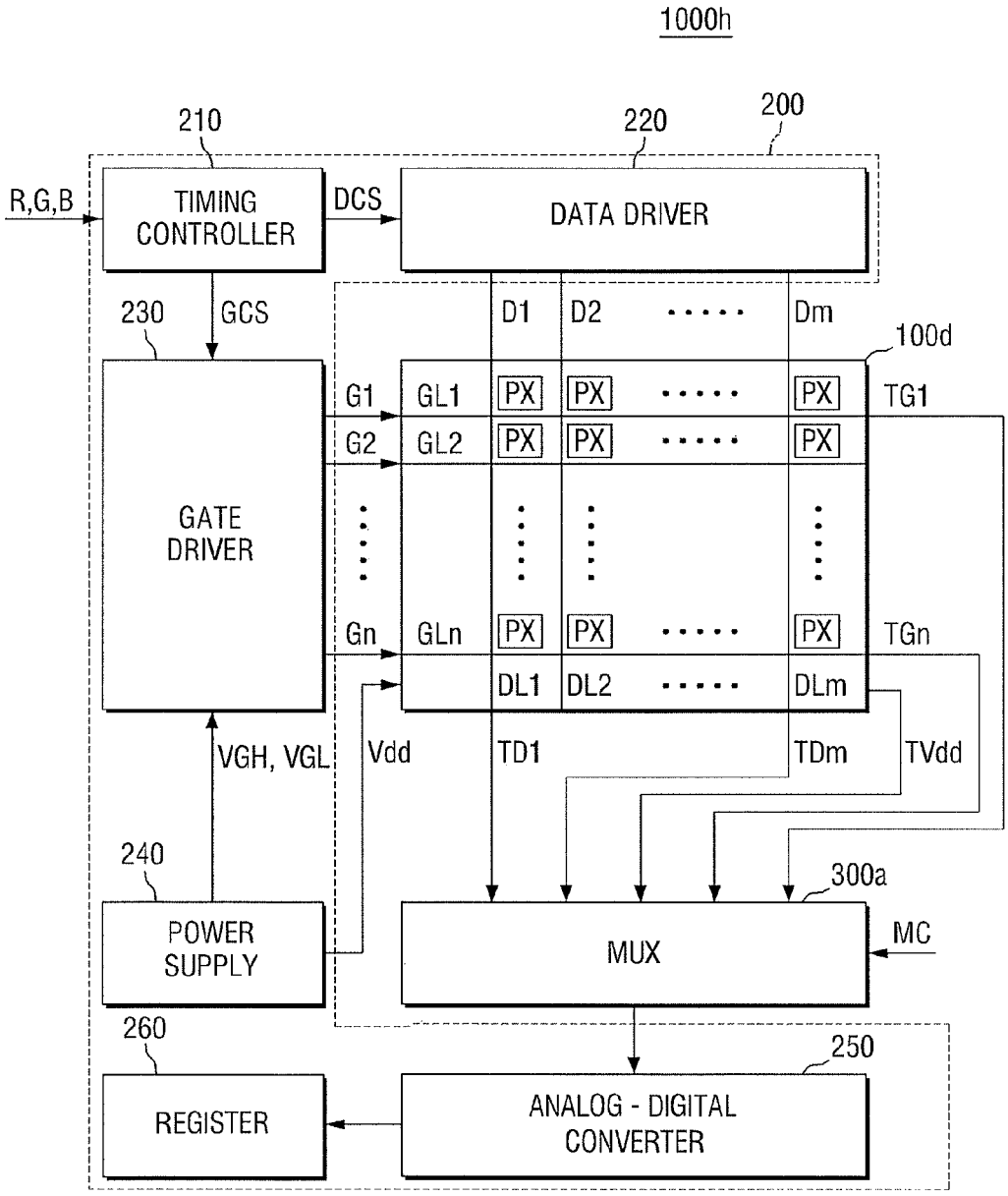
FIG. 10 is a block diagram of a display device according to an exemplary embodiment.

Another exemplary embodiment will now be described with reference to FIG. 10. FIG. 10 is a block diagram of a display device 1000*h* according to another exemplary embodiment.

Referring to FIG. 10, the display device 1000*h* may include a display panel 100*d*, a driving unit 200, and a selector 300*a*. The selector 300*a* may be a separate element not included in the driving unit 200. When the selector 300*a* is formed as a separate element not included in the driving unit 200, if the driving unit 200 is formed as a single IC chip, the number of input terminals of the driving unit 200 may be reduced. Other features of the selector 300*a* are substantially identical to those of the selector 270*a* of FIG. 9, and thus a description thereof is omitted. For simplicity, other elements of the display device 1000*h* substantially identical to those of the display device 1000*g* shown in FIG. 9 are indicated by like reference numerals, and thus their description is omitted.

By way of summation and review, when a display device has a defect, it may need to be disassembled in order to analyze the cause of the defect and/or to repair the defect. However, if the display device is disassembled, the elements of the display device such as the display panel may be damaged, which results in additional defects. Further, the additional defects may make it difficult to identify the cause of the original defect. Also, the product may have to be discarded even after the original defect is repaired.

In contrast, embodiments relate a display device whose defects may be easily analyzed and repaired without being disassembled such that defects that may occur in a process of disassembling the display device may be avoided. Further, embodiments relate to a display device and to a display device whose wiring defects may be easily inspected, e.g., without being disassembled. Embodiments also relate to a display device in which wiring defects of the display device may be detected without the need to disassemble the display device. In addition, since the wiring defects of the display device may be detected without the need to disassemble the display device, the possibility of defects that may occur in the process of disassembling the display device may be reduced and/or prevented.

However, aspects of the embodiments are not restricted to the one set forth herein. The above and other aspects of the present invention will become more apparent to one of ordinary skill in the art to which the present invention pertains by referencing the detailed description of the present invention given below.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including pixels for displaying an image; and a driving unit that generates driving signals for driving the pixels and supplies the driving signals to driving lines connected to the pixels, the driving signals including a driving power supply voltage supplied to the pixels of the display panel, wherein:

the pixels receive the driving signals and output the driving signals as test driving signals including a test driving power supply voltage, the test driving power supply voltage generated from the driving power supply voltage and output from the pixels of the display panel, and the driving unit includes an analog-digital converter to which the test driving signals are input, and includes a register that stores signal levels detected by the analog-digital converter.

2. The display device of claim 1, wherein the driving signals include control signals for controlling the pixels, and the test driving signals include test control signals generated from the control signals.

3. The display device of claim 2, wherein:

the display panel includes a plurality of gate lines arranged sequentially, the plurality of gate lines included in the driving lines, the control signals include a plurality of gate signals that are transmitted to the gate lines, respectively, and the test control signals include test gate signals generated from ones of the plurality of gate signals.

4. The display device of claim 3, wherein the ones of the plurality of gate signals are transmitted to gate lines located farthest from a middle of the display panel from among the plurality of gate lines.

5. The display device of claim 2, wherein:

the display panel includes a plurality of data lines arranged sequentially, the plurality of data lines included in the driving lines, the control signals include a plurality of data signals that are transmitted to the data lines, respectively, and the test control signals include test data signals generated from ones of the plurality of data signals.

6. The display device of claim 5, wherein the ones of the plurality of data signals are transmitted to data lines located farthest from the middle of the display panel from among the plurality of data lines.

7. The display device of claim 2, wherein the display panel includes a plurality of pixels, the control signals being transmitted to ones of the pixels located adjacent to edges of the display panel.

8. The display device of claim 1, further comprising a selector that receives the test driving signals and that transmits one of the test driving signals to the analog-digital converter.

9. The display device of claim 8, wherein the driving signals include control signals for controlling the pixels, and the test driving signals include test control signals generated from the control signals.

10. The display device of claim 9, wherein:

the display panel includes a plurality of gate lines arranged sequentially, the plurality of gate lines included in the driving lines, the control signals include a plurality of gate signals that are transmitted to the gate lines, respectively, and the test control signals include test gate signals generated from ones of the plurality of the gate signals, the test gate signals being generated from gate signals that are transmitted to gate lines located farthest from the middle of the display panel from among the plurality of gate lines.

11. The display device of claim 9, wherein:

the display panel includes a plurality of data lines arranged sequentially, the plurality of data lines included in the driving lines, the control signals include a plurality of data signals that are transmitted to the data lines, respectively, and the test control signals include test data signals generated from at ones of the plurality of data signals, the test data signals being generated from data signals that are transmitted to data lines located farthest from the middle of the display panel from among the plurality of data lines.

12. A display device, comprising:

a display panel including pixels for displaying an image; and a driving unit that generates control signals for controlling the pixels and supplies the driving signals to control lines connected to the pixels, the control signals including a driving power supply voltage supplied to the pixels of the display panel, wherein:

the pixels receives the control signals and outputs the control signals as test control signals including a test driving power supply voltage, the test driving power supply voltage generated from the driving power supply voltage and output from the pixels of the display panel, and the driving unit includes an analog-digital converter to which the test control signals are input, and includes a register that stores signal levels detected by the analog-digital converter.

13. The display device of claim 12, wherein:

the display panel includes a plurality of gate lines arranged sequentially, the plurality of gate lines included in the control lines, the control signals include a plurality of gate signals that are transmitted to the gate lines, respectively, and the test control signals include test gate signals generated from ones of the plurality of gate signals.

14. The display device of claim 13, wherein the ones of the plurality of gate signals are transmitted to gate lines located farthest from a middle of the display panel from among the plurality of gate lines.

15. The display device of claim 12, wherein:

the display panel includes a plurality of data lines arranged sequentially, the plurality of data lines included in the control lines, the control signals include a plurality of data signals that are transmitted to the data lines, respectively, and the test control signals include test data signals generated from ones of the plurality of data signals.

16. The display device of claim 15, wherein the ones of the plurality of data signals are transmitted to data lines located farthest from the middle of the display panel from among the plurality of data lines.

17. The display device of claim 12, further comprising a selector that receives the test control signals and that transmits one of the test control signals to the analog-digital converter.

18. A display device, comprising:

a display panel including pixels for displaying an image; and a driving unit that generates a driving power supply voltage for driving the pixels and supplies the driving power supply voltage to power lines connected to the pixels, wherein:

the pixels receives the driving power supply voltage and outputs the driving power supply voltage as a test driving power supply voltage, and the driving unit includes an analog-digital converter to which the test driving power supply voltage is input, and includes a register that stores a signal level detected by the analog-digital converter.

* * * * *